US008202375B2

(12) United States Patent
Karlsson et al.

(10) Patent No.: US 8,202,375 B2
(45) Date of Patent: Jun. 19, 2012

(54) TEMPERATURE-STABLE CAST IRON ALLOY AND USE OF SAID ALLOY

(75) Inventors: Asger Karlsson, Bröndby Strand (DK); Rasmus Kirkegaard Stage, Holstebro (DK)

(73) Assignee: FLSMIDTH A/S, Valby (DK)

( * ) Notice: Subject to any disclaimer, the term of this patent is extended or adjusted under 35 U.S.C. 154(b) by 353 days.

(21) Appl. No.: 12/377,020

(22) PCT Filed: Jun. 12, 2007

(86) PCT No.: PCT/IB2007/052213

§ 371 (c)(1),
(2), (4) Date: Feb. 10, 2009

(87) PCT Pub. No.: WO2008/029304

PCT Pub. Date: Mar. 13, 2008

(65) Prior Publication Data

US 2010/0155042 A1 Jun. 24, 2010

(30) Foreign Application Priority Data

Sep. 8, 2006 (DK) ..... 2006 01154

(51) Int. Cl.
*C22C 37/08* (2006.01)

(52) U.S. Cl. ..... 148/324; 420/11; 420/16; 420/34; 420/100

(58) Field of Classification Search ..... 420/11, 420/12, 34, 16, 100, 101; 148/324
See application file for complete search history.

(56) References Cited

U.S. PATENT DOCUMENTS

| | | | | |
|---|---|---|---|---|
| 5,106,577 | A * | 4/1992 | Fesler | 420/12 |
| 2007/0095443 | A1 | 5/2007 | Dolman | |

FOREIGN PATENT DOCUMENTS

| | | | |
|---|---|---|---|
| CN | 1036795 | C | 4/1989 |
| CN | 1706976 | | 12/2005 |
| CN | 1706976 | A | 12/2005 |
| WO | 2004104253 | A1 | 2/2004 |

OTHER PUBLICATIONS

Machine-English translation of Chinese patent CN 1706976, Dec. 14, 2005, Hu Hengfa et al.*
Machine-English translation of Chinese patent CN 1099075, Feb. 22, 1995, Fu Hanguang et al.*
Office Action for Corresponding Chinese Application dated Apr. 14, 2010 (translated version).

* cited by examiner

*Primary Examiner* — Deborah Yee
(74) *Attorney, Agent, or Firm* — Jeffrey S. Melcher; Manelli Selter PLLC

(57) ABSTRACT

A description is given of a temperature-stable cast-iron alloy having high wear resistance at temperatures between 500 and 900° C. The alloy is characterized in that it has the following composition expressed in weight percentages: chromium: 15.0-20.0%, carbon: 1.0-2.0%, manganese: 0.8-1.2%, silicon: 1.2-1.5%, nickel: 1.5-2.5%, balance iron and unavoidable metallic and non-metallic contaminants where the non-metallic contaminants comprise nitrogen, oxygen, phosphorous and sulphur. Hereby is obtained a cast-iron alloy which has a higher wear resistance and a reduced tendency to form the undesirable sigma phase when heated to temperatures between 500 and 900° C. as compared to the known allows.

11 Claims, No Drawings

TEMPERATURE-STABLE CAST IRON ALLOY AND USE OF SAID ALLOY

This application is a national stage entry under 35 USC 371 of International App'n No. PCT/IB2007/052213, filed 12 Jun. 2007, designating the United States. This application claims foreign priority under 35 USC 119 and 365 to Denmark Patent App'n Ser. No. PA200601154, filed 8 Sep. 2006.

The present invention relates to a temperature-stable cast-iron alloy having a high wear resistance at temperatures ranging between 500 and 900° C.

Many industries use machines containing machine parts which incur significant wear at relatively high temperatures in excess of 500° C. For example, in the cement manufacturing industry a so-called clinker cooler is used for cooling cement clinker which is introduced to the clinker cooler from a preceding kiln at a temperature ranging between 1300 and 1450° C. The cement clinker is directed through the clinker cooler by means of appropriate means of conveyance which are typically made up of some form of elements which are reciprocated in the direction of movement of the cement clinker, and thus exposed to significant wear at temperatures ranging between 500 and 900° C.

From WO 2004/104253 is known a wear-resistant cast-iron alloy having the following composition expressed in weight percentages:
chromium: 12-25%,
carbon: 1.5-6%,
manganese: 2-7%,
silicon: up to 1.5%,
molybdenum: up to 2%,
nickel: up to 4%,
micro alloying elements selected from the group consisting of titanium, zirconium, niobium, boron, vanadium, and tungsten: up to 2% of each of one or more of the elements, and balance iron.

According to the publication, the alloy is subjected to heat treatment in order to give it a martensitic matrix. This type of matrix is very hard and brittle, and machine elements manufactured from such material are prone to cracking if subjected to impacts or blows. Furthermore, this type of matrix lacks thermal stability due to its softening at temperatures in excess of 400° C.

The applicant of the present patent application also has experience with regard to a cast-iron alloy according to European standard 10295 (2002), material: G-X40 CrNiSi25-12, Material No.: 1.4837, which has the following composition expressed in weight percentages:
chromium: 24.0-27.0%,
carbon: 0.3-0.5%,
manganese: up to 2.0%,
silicon: 1.0-2.5%,
molybdenum: up to 0.5%,
nickel: 11.0-14.0%,
phosphorous: up to 0.040% and
sulphur: up to 0.030% and a modified version hereof having the following composition expressed in weight percentages:
chromium: 24.0-26.0%,
carbon: 0.7-0.9%,
manganese: 0.6-1.0%,
silicon: 1.5-2.0% and
nickel: 2.5-3.5%

Experience with these two materials has shown that after prolonged heating to temperatures between 500 and 900° C. both materials tend to form a sigma phase which is a brittle inter-metallic phase consisting of equal parts of iron and chromium, and hence be brittle, and that they are not particular wear resistant.

It is the objective of the present invention to provide a cast-iron alloy having a higher wear resistance and a reduced tendency to form a sigma phase at temperatures between 500 and 900° C. as compared to the cast-iron alloys currently available.

According to the invention this is achieved by a cast-iron alloy according to the invention having the following composition expressed in weight percentages:
chromium: 15.0-20.0%,
carbon: 1.0-2.0%,
manganese: 0.8-1.2%,
silicon: 1.2-1.5%,
nickel: 1.5-2.5%,
balance iron and unavoidable metallic and non-metallic contaminants, where the non-metallic contaminants comprise nitrogen, oxygen, phosphorous and sulphur.

Hereby is obtained a cast-iron alloy having a higher wear resistance and a reduced tendency to form the undesired sigma phase when heated to temperatures between 500 and 900° C. as compared to the previously mentioned known alloys.

Laboratory experiments carried out by the applicant of the present patent application have indicated that the alloy according to the invention has significantly improved wear characteristics compared to the alloy according to the European standard 10295 and the modified version hereof, both defined above. The test results show that the alloy according to the invention has a wear resistance which is approximately seventeen times higher than that of the alloy according to European standard 10295 and seven times as high as that of the modified version hereof. The improved wear resistance is mainly ascribable to the optimization of the carbon-chromium ratio, resulting in optimum formation of chromium carbides which constitute the wear-resistant component of the alloy.

Furthermore, laboratory experiments during which the alloy according to the invention over a period of 8 weeks underwent heat treatment at a temperature of 500° C. with a subsequent microscopy examination, have shown that the alloy exhibits significant heat stability, given the absence of any signs of sigma phase formation.

In order to avoid significant deterioration of the mechanical characteristics of the iron alloy, the non-metallic contaminants comprising nitrogen, oxygen, phosphorous and sulphur should not exceed the maximum limits specified below:
maximum 0.020 N, maximum 10 ppm O, maximum 0.040 P, and maximum 0.030 S.

The cast-iron alloy according to the invention preferably comprises 16.0-19.0 weight percentage chromium, more preferably 16.5-18.5 weight percentage and most preferably 17.0-18.0 weight percentage chromium.

Furthermore, the cast-iron alloy according to the invention preferably comprises 1.2-1.8 weight percentage carbon, most preferably 1.4-1.6 weight percentage carbon.

The cast-iron alloy according to the invention preferably has an austenitic-ferritic matrix.

The cast-iron alloy can be manufactured and cast into blanks using generally known techniques.

The described cast-iron alloy is particularly suitable for use in connection with machine parts in clinker coolers for cooling cement clinker.

The invention claimed is:

1. Temperature-stable cast-iron alloy having high wear resistance at temperatures between 500-900° C. consisting essentially of the following composition expressed in weight percentages:

chromium: 16.0-19.0%,
carbon: 1.2-1.8%,
manganese: 0.8-1.2%,
silicon: 1.2-1.5%,
nickel: 1.5-2.5%, and balance iron and unavoidable metallic and non-metallic contaminants where the non-metallic contaminants comprise nitrogen, oxygen, phosphorous and sulphur, wherein the alloy is in the form of an austenitic-ferritic matrix, and wherein the alloy does not form a sigma phase when heated to a temperature of 500° C. for eight weeks.

2. A method comprising the step of cooling cement clinker in a clinker cooler by contacting cement clinker with a machine part in the clinker cooler at a temperature of from 500 to 900° C., the machine part being formed from a cast-iron alloy consisting essentially of the following composition expressed in weight percentages:

chromium: 15.0-20.0%,
carbon: 1.0-2.0%,
manganese: 0.8-1.2%,
silicon: 1.2-1.5%,
nickel: 1.5-2.5%, and balance iron and unavoidable metallic and non-metallic contaminants where the non-metallic contaminants comprise nitrogen, oxygen, phosphorous and sulphur and wherein the alloy is in the form of an austenitic-ferritic matrix, and wherein the alloy does not form a sigma phase when heated to a temperature of 500° C. for eight weeks.

3. The method according to claim 2, wherein the alloy consisting essentially of 16.0-19.0 weight percentage chromium.

4. The method according to claim 2, wherein the alloy consisting essentially of 16.5-18.5 weight percentage chromium.

5. The method according to claim 2, wherein the alloy consisting essentially of 17.0-18.0 weight percentage chromium.

6. The method according to claim 2, wherein the alloy consisting essentially of 1.2-1.8 weight percentage carbon.

7. The method according to claim 6, wherein the alloy consisting essentially of 1.4-1.6 weight percentage carbon.

8. Temperature-stable cast-iron alloy according to claim 1, wherein the alloy contains chromium carbides.

9. Temperature-stable cast-iron alloy according to claim 8, wherein the carbon-chromium ratio is optimized to form the chromium carbides.

10. Temperature-stable cast-iron alloy according to claim 1, wherein the alloy comprises a maximum of 0.020 weight % nitrogen, a maximum of 10 ppm oxygen, a maximum of 0.040 weight % phosphorous, and a maximum of 0.030 weight % sulphur.

11. A clinker machine part constructed for cooling cement clinker, the part comprising the temperature-stable cast-iron alloy according to claim 1.

* * * * *